US007477869B2

(12) United States Patent
Kawaai et al.

(10) Patent No.: US 7,477,869 B2
(45) Date of Patent: Jan. 13, 2009

(54) ELECTROPHOTOGRAPHIC PRINTING APPARATUS AND PRINTING SYSTEM

(75) Inventors: Yoshinori Kawaai, Ibaraki (JP); Sadanori Kobashi, Ibaraki (JP); Kazutoshi Obara, Ibaraki (JP); Kiyoshi Suzuki, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 497 days.

(21) Appl. No.: 11/139,076

(22) Filed: May 26, 2005

(65) Prior Publication Data

US 2005/0265761 A1 Dec. 1, 2005

(30) Foreign Application Priority Data

May 28, 2004 (JP) ..... 2004-158591

(51) Int. Cl.
*G03G 15/00* (2006.01)

(52) U.S. Cl. ..... 399/394; 399/381; 399/388; 399/395; 271/226

(58) Field of Classification Search ..... 271/226–255
See application file for complete search history.

(56) References Cited

U.S. PATENT DOCUMENTS 6,305,856 B1 * 10/2001 Miyazaki ..... 400/279
6,788,322 B2 * 9/2004 Morita ..... 347/139

FOREIGN PATENT DOCUMENTS

| | | | |
|---|---|---|---|
| JP | 06079916 A | * | 3/1994 |
| JP | 07-041969 | | 3/1995 |
| JP | 08230231 A | * | 9/1996 |
| JP | 09219776 A | * | 8/1997 |

OTHER PUBLICATIONS

Japanese Laid-open Utility-Model Application No. 1-76835, Mar. 22, 1989.

* cited by examiner

*Primary Examiner*—Jill E. Culler
*Assistant Examiner*—'Wyn' Q Ha
(74) *Attorney, Agent, or Firm*—Blakely, Sokoloff, Taylor & Zafman LLP

(57) ABSTRACT

In an electrophotographic printing apparatus for printing an image to an image transfer sheet medium by producing a latent image on a photosensitive unit and transferring the latent image to the image transfer sheet medium, a width-directional position of the image transfer sheet medium is detected before the latent image is produced and the same after the latent image is produced on the photosensitive unit by the width-directional positional sensor, and the detection results are compared with one another; and it is determined from the comparison result whether or not printing operation is continued.

6 Claims, 6 Drawing Sheets

- PRIOR ART -

- PRIOR ART -

ELECTROPHOTOGRAPHIC PRINTING APPARATUS AND PRINTING SYSTEM

The present application claims priority to and incorporates herein by reference the entire contents of Japanese priority application no., 2004-158591, filed in Japan on May 28, 2004.

BACKGROUND OF THE INVENTION

1. Field of the Invention

The present invention relates to an electrophotographic printing apparatus and a printing system, and, in particular, to an electrophotographic printing apparatus and a printing system having a configuration for detecting a position of an image transfer sheet medium.

2. Description of the Related Art

Japanese Laid-open Patent Application No. 8-230231 discloses a digital image forming apparatus. In this apparatus, during conveyance of transfer paper to a toner image transfer position, paper end position detection is carried out, and a position of writing a latent image is controlled appropriately for correcting a possible skew of the transfer paper that is detected.

Japanese Laid-open Utility-Model Application No. 1-76835 discloses a copier in which, during conveyance of transfer paper to a toner image transfer position, intermediate rollers and registration rollers are provided in sequence, and, when the registration rollers feed the transfer paper to the toner image transfer position, the hold of the transfer paper by the immediate rollers is released to avoid meandering of the transfer paper.

However, even applying such a method, it may be difficult to positively detect, even with a simple configuration, a possible printing start position error.

SUMMARY OF THE INVENTION

An electrophotographic printing apparatus and printing system is described. In one embodiment, an electrophotographic printing apparatus for printing an image on an image transfer sheet medium by producing a latent image on a photosensitive unit and transferring the image to the image transfer sheet medium, comprises a width-directional positional sensor to detect a width-directional position of the image transfer sheet medium and a printing start position control unit to control a printing start position in a width direction of the image transfer sheet medium based on a detection result of the width-directional positional sensor. The width-directional positional sensor detects a width-directional position of the image transfer sheet medium before the latent image is produced and also after the latent image is produced on the photosensitive unit, and detection results thereof are compared with one another; and it is determined from the comparison result whether or not printing operation is further continued.

DETAILED DESCRIPTION

Embodiments of the present invention has been devised to provide a configuration of a printing system in which, even with a simple configuration, a printing start position error can be positively detected.

According to one embodiment of the present invention, detection of a position of an image transfer sheet medium, such as a transfer paper, is performed before a latent image is produced on a photosensitive unit and also after the latent image is produced on the photosensitive unit and after the image transfer sheet medium is fed by registration rollers for the photosensitive unit.

By detecting the position of the image transfer sheet medium several times during the conveyance thereof for the toner image transfer position, it is possible to positively detect a possible skew of the image transfer sheet medium during the conveyance.

Figure 1:
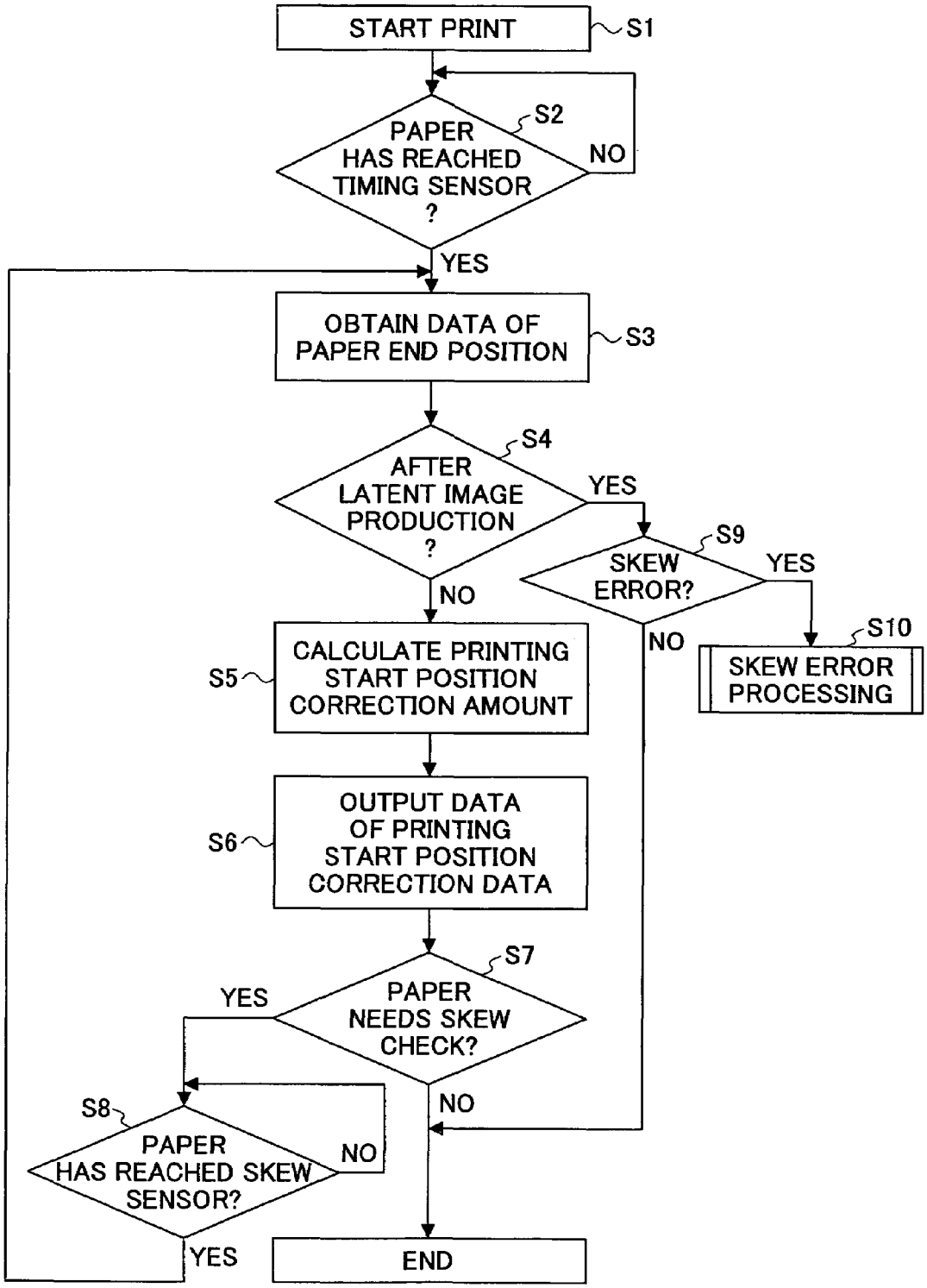
FIG. 1 shows a paper end position detecting flow chart of an electrophotographic printing apparatus according to an embodiment of the present invention.
Figures 2A, 2B, 2C, 2D:
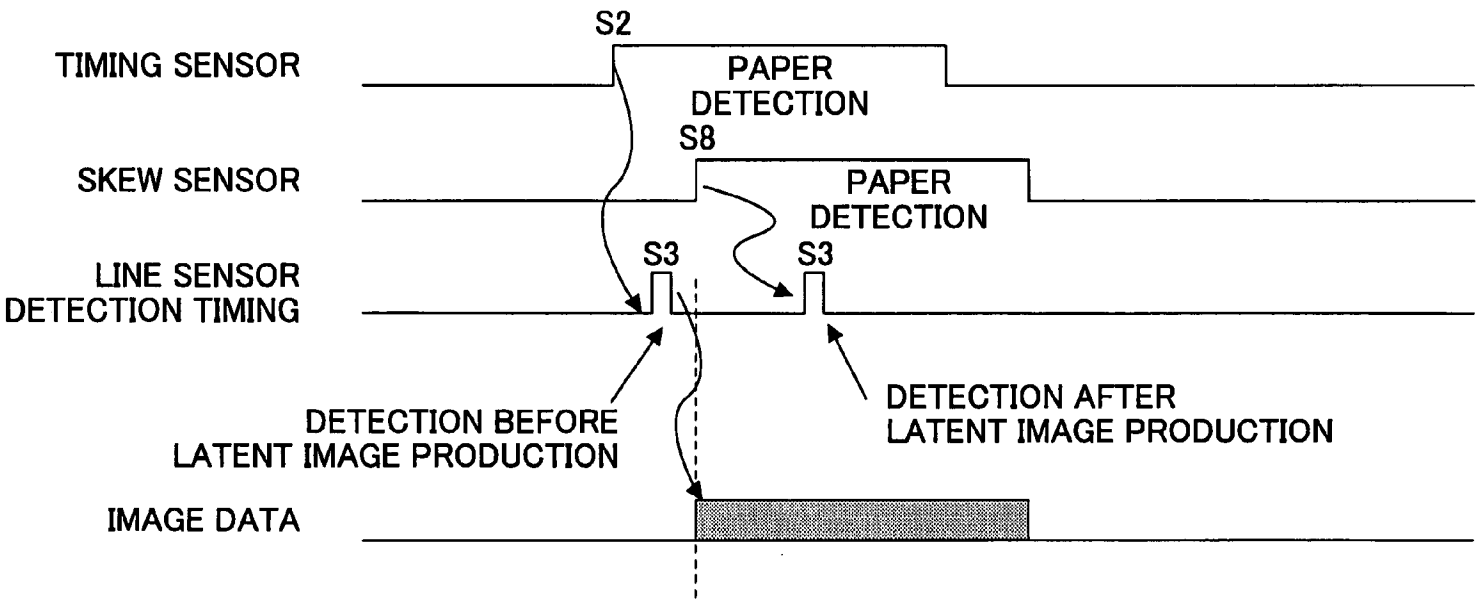
FIGS. 2A through 2D show a paper end position detecting sequence of the electrophotographic printing apparatus according to the embodiment of the present invention.
Figure 3:
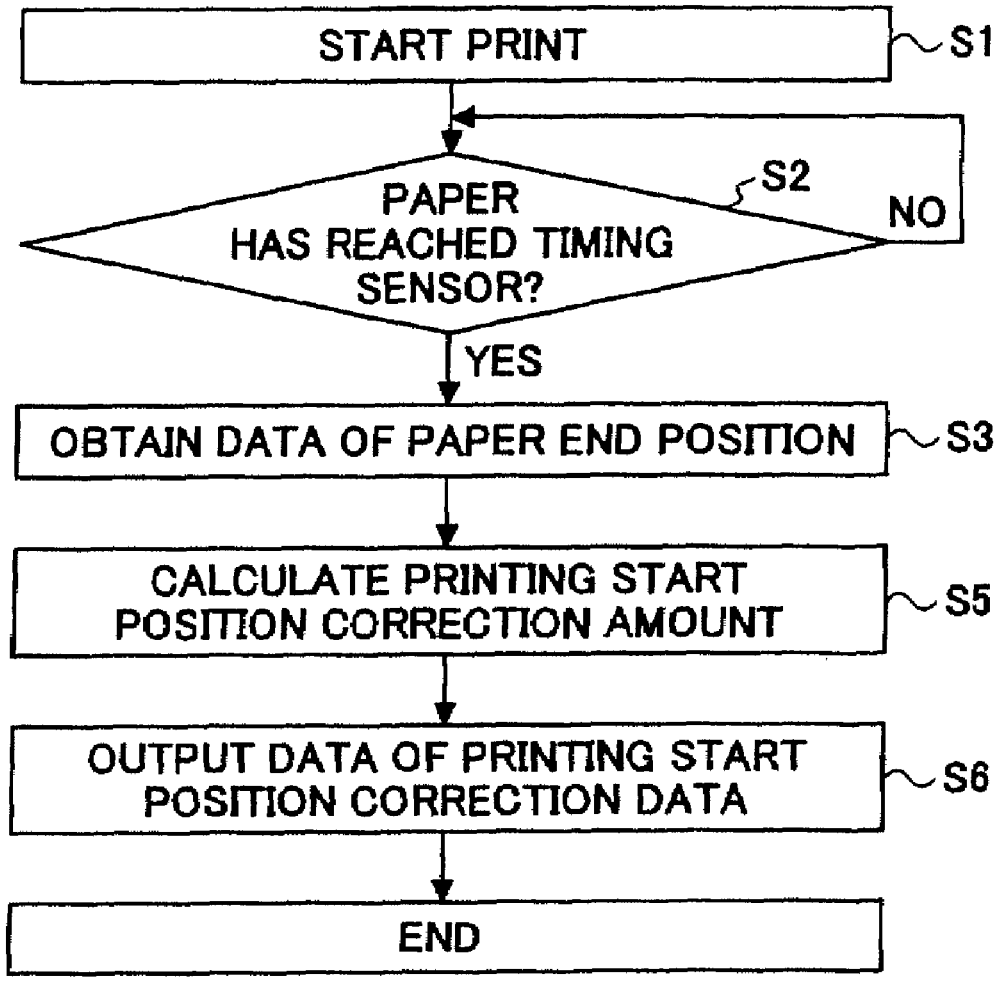
FIG. 3 shows a paper end position detecting flow chart in the related art.
Figure 4:
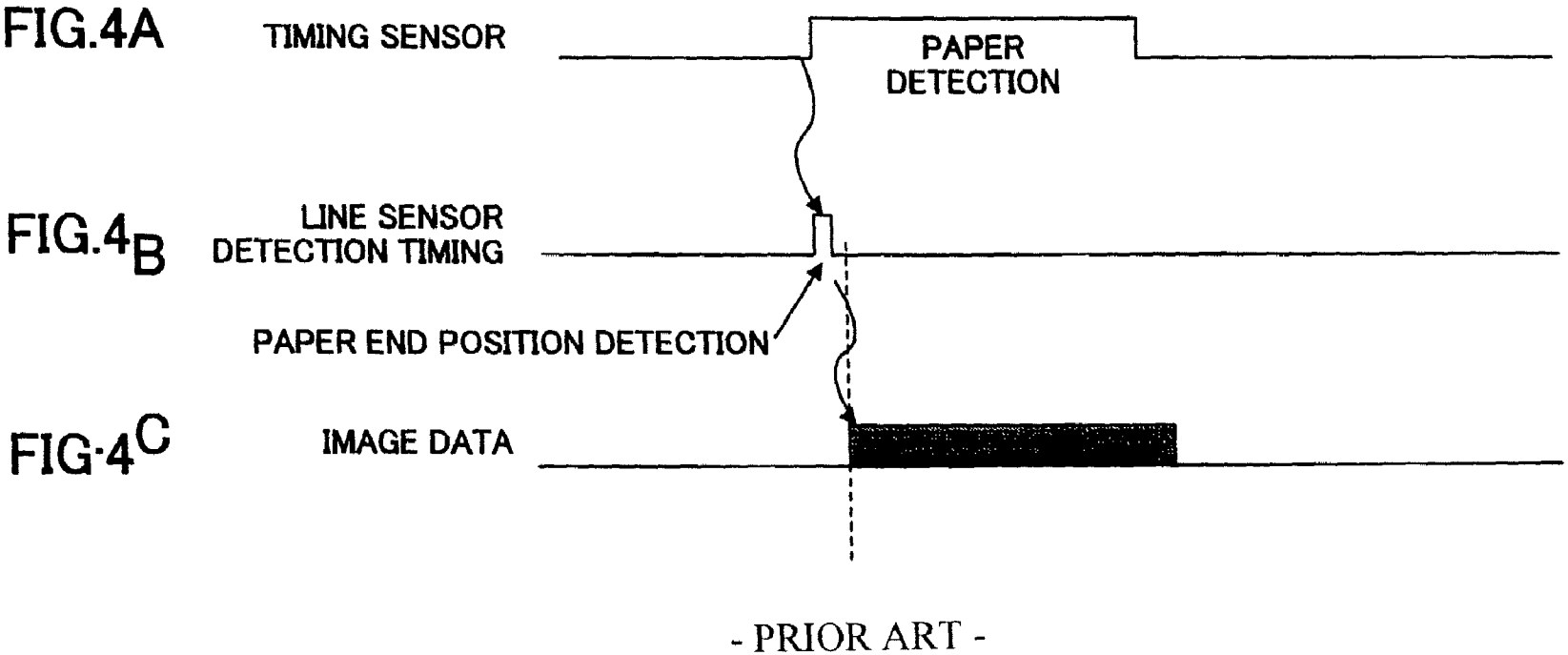
FIGS. 4A through 4C show a paper end position detecting sequence in the related art.
Figure 5:
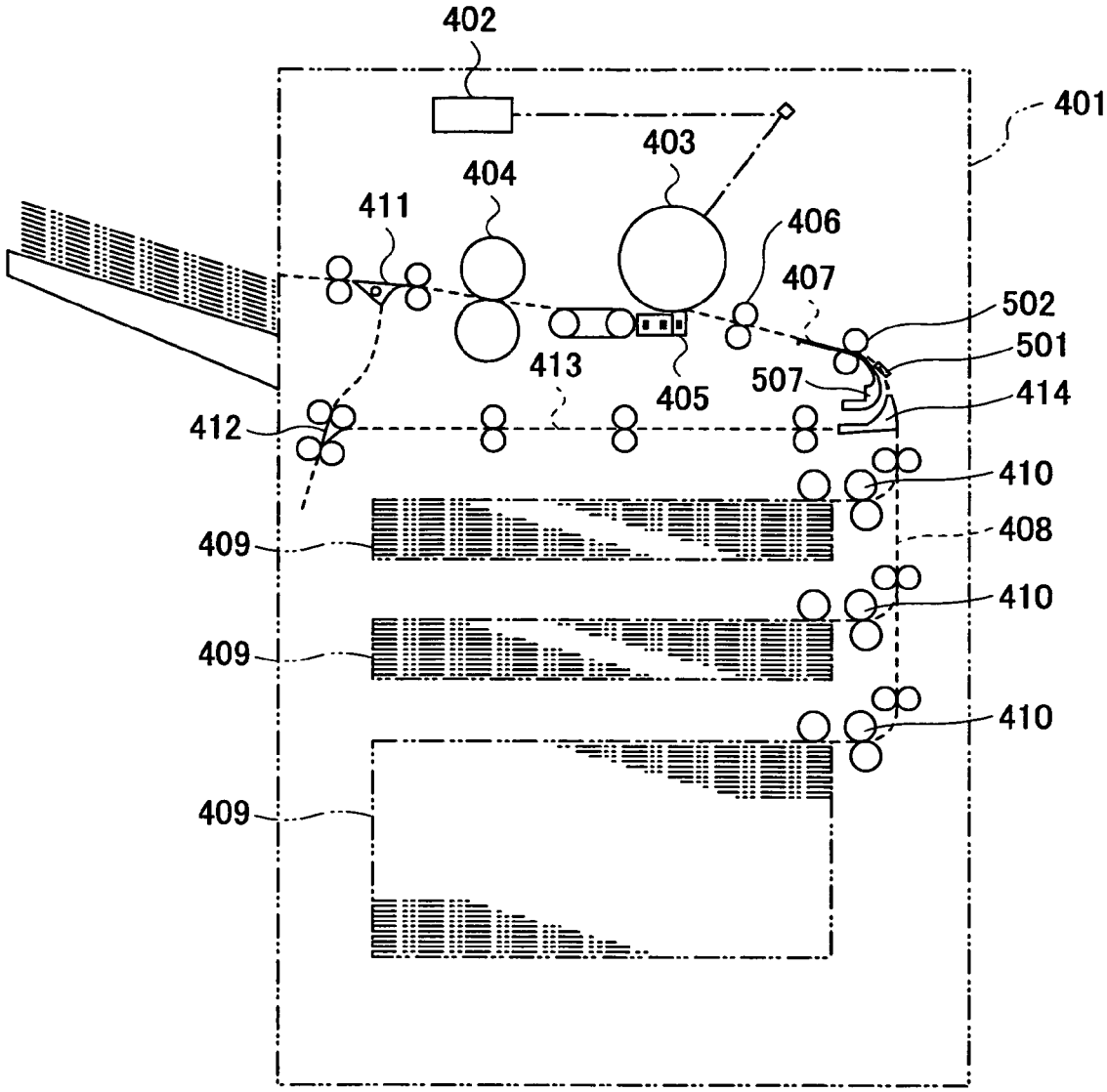
FIG. 5 shows a side elevational sectional view of one example of an electrophotographic printing apparatus.
Figure 6:
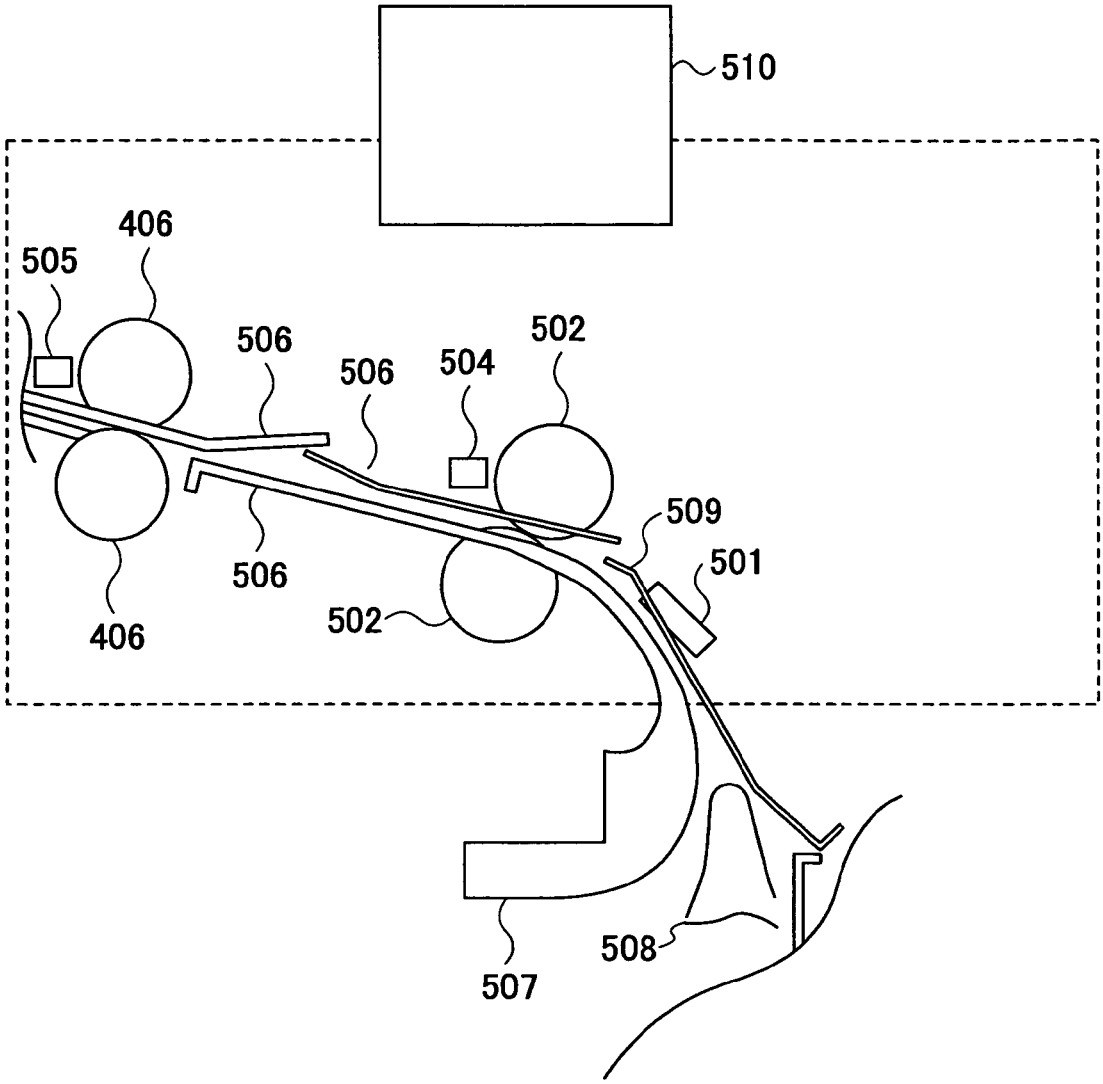
FIG. 6 shows a paper end position detecting mechanism unit of the electrophotographic printing apparatus shown in FIG. 5.

Other features of embodiments of the present invention will become more apparent from the following detailed description when read in conjunction with the accompanying drawings:

FIG. 5 shows a side elevational sectional view of an electrophotographic printing apparatus, in particular, a laser beam printer in one embodiment of the present invention. FIG. 6 shows a paper end position detecting mechanism part of the laser beam printer shown in FIG. 5, applying a line sensor, for example, to detect a paper end position. FIG. 3 shows an operation flow chart of paper end position detecting operation applying the line sensor according to the related art, described as a comparison example for the embodiment of the present invention (as shown in FIG. 1). FIGS. 4A through 4C show an operation sequence of the paper end position detecting operation applying the line sensor according to the related art, also described as the comparison example for the present invention (shown in FIGS. 2A through 2D).

First, for the purpose of comparison, the related art is described with reference to FIGS. 3, 4A through 4C, 5 and 6.

As shown in FIG. 5, the laser beam printer includes a sheet feeding device 409 which can be drawn out in a direction perpendicular to this figure. After the sheet feeding device 409 is pushed into a predetermined loading position so that it is loaded in the apparatus body of the laser beam printer 401, this state is detected by a sensor (not shown). As a result, a paper lifting table (not shown) is engaged by a driving gear (not shown), and therewith, the paper lifting table is raised until a top of paper sheets stacked on the paper lifting table (if no paper exists on the table, a top surface of the table) comes into contact with a paper feeding roller 410. The printer 401 also includes a photosensitive drum 403 which then starts rotating according to a signal from a controller not shown. After that, a surface of the photosensitive drum 403 is uniformly charged electrically by use of a corona charger not shown.

Then, on the electrically-charged photosensitive drum 403, a laser beam is applied by a scanning optical unit 402 according to image data transmitted from a host system (not shown). Thereby, an electrostatic latent image is produced on the photosensitive drum 403 corresponding to the given image data. The electrostatic latent image is developed by use of a developing device (not shown) with toner, when the electrostatic latent image produced on the photosensitive drum 403 reaches a position of the developing device due to the rotation of the drum 403. Thus, the latent image is visualized as a toner image on the photosensitive drum 403. Such a process is a well-known and called an electrophotographic process. The toner image produced is transferred to the paper fed from the sheet feeding device 409 by use of a transfer removing device 405.

The toner image transferred to the paper from the photosensitive drum 403 is fixed thereto by a fixing device 404. A gate member 411 switches a conveyance path of the paper. Specifically, the gate member 411 conveys the paper in a left direction of FIG. 5 for an ejecting part, or conveys the paper in a bottom direction, selectively. The paper conveyed in the left direction from the gate member 411 is ejected to a post processing machine (not shown). On the other hand, the paper conveyed in the bottom direction from the gate member 411 is once drawn downward by means of rollers in the vicinity of an inverting gate 412, and after that, is conveyed to a both-side conveyance path 413.

A gate member 414 switches a conveyance path of the paper conveyed from a conveyance path 408 so as to convey the paper to a printing conveyance path 407 or to convey the paper conveyed from the both-side conveyance path 413 to the printing conveyance path 407 again. Since the printed side of the paper is made to face downward by use of the inverting gate 412, printing is performed at this time on the top side of the paper on which no printing has been made yet. The paper for which printing is made on both sides is conveyed in the left direction by the gate member 411, and is eject to the post processing machine.

When the toner image is transferred to the paper, it is preferable that the paper conveyed from the sheet feeding device 409 or the both-side conveyance path 413 always has a fixed conveyance position in a width direction. However, due to a movement of the paper in the sheet feeding device 409, a skew occurring during the conveyance, a shrinkage of the paper upon passing through the fixing device 404 or such, the width-directional position of each page may differs from each other, and as a result, printing is made in such that the printing start position in the width direction differs among the respective pages. In order to avoid such a difference in the printing start position, a line sensor 501 is disposed along the conveyance path as shown in FIG. 6, to thereby perform the paper end position detection, and then, the printing start position is corrected as disclosed by Japanese Laid-open Patent Application No.8-230231, for example.

Paper end position detection and printing start position correction processing in the related art (merely for the purpose of comparison as mentioned above) is described next with reference to FIG. 3.

The line sensor 501 is a reflective line sensor having multiple LEDs (not shown), multiple photodetectors, and an internal control circuit unit, and is disposed in a direction perpendicular to the paper conveyance direction in a paper guide 508 through which the paper conveyed from the sheet feeding device 409 or from the both-side conveyance path 413 passes. Further, a line sensor 501 is disposed at a position such that an end surface of the paper having a standard size should pass on a detection surface of the line sensor 501. Further, in order to improve detection accuracy, a paper guide 507 and the paper guide 509 are disposed to have a distance therebetween such that a movable range of the paper passing therethrough should be limited within a predetermined amount.

When printing is started in the laser beam printer 401 (Step S1 of FIG. 3), a printer control unit 510 determines in Step S2 whether or not paper (i.e., an image transfer sheet medium) has reached a timing sensor 504. When the paper has reached the timing sensor 504 (Yes of Step S2), the printer control unit 510 obtains paper end position data by means of the line sensor 501 in Step S3. A reason why the timing at which the paper has reached the timing sensor 504 is applied as a trigger to obtain the paper end position data, is that, a timing for obtaining the paper end position data should be fixed for each particular type of the paper. The obtained paper end position data is compared with reference paper end position data previously recorded in a memory of the printer control unit 510. Then, to the obtained difference therebetween, printing start position correction data which is set previously at a time of initial adjustment is added in Step S5. Thus, a correction value for the printing start position is determined. In Step S6, the printing control unit 510 outputs the obtained printing start position correction data to a printing start position correction circuit not shown. In the printing start position correction circuit, based on the printing start position correction data, printing start position correction processing for a paper width direction is performed on image data given by a host system to be applied to write a latent image. Further, the scanning optical unit 402 produces the latent image on the photosensitive drum 403 from the image data given by the host system in timing thus corrected by the printing start position correction circuit. This paper end position detection and printing start position correction processing may be carried out either for the paper conveyed from the sheet feeding device 409 or the paper conveyed from the both-side conveyance path 413.

A sequence for obtaining the paper end position data by means of the line sensor 501 in the related art is described next.

First, the printer control unit 510 transmits a signal to cause the LEDs of the line sensor 501 to emit light, a clock signal and a start signal, to the line sensor 501. With this LED light emitting signal, the LEDs of the line sensor 501 are turned on. Light thus emitted by the LEDs is received by the photodetectors after being reflected by the conveyed paper. Then, the internal control unit of the line sensor 501 outputs voltage outputs obtained from the photodetectors, transformed therein from the received light by a photoelectric transform function, in synchronization with the above-mentioned clock signal for each photodetector. Each of the respective output voltages has a high level for a position reflected by the conveyed paper in which the reflected light is obtained while the same has a low level for a position not reflected by the paper in which no reflected light is received. These analog outputs thus obtained in synchronization with the clock signal are converted into digital signals by means of an A-D converter not shown provided between the printer control unit 510 and the line sensor 501, and are transmitted to the printer control unit 510 as "H" signals for the positions reflected by the conveyed paper and "L" signals for the positions not reflected by the paper. Since the line sensor 501 and the paper have the mutual positional relationship mentioned above, the number of the "H" signals depends on a range of the paper actually reflecting the light for the photodetectors. The printer control unit 510 counts the digitized "H" signals output from the line sensor 501, and thus, recognizes the paper end position.

After counting the outputs of the line sensor.501, the printer control unit 510 turns off the LED light emitting signal for the line sensor 501, and finishes the series of steps of the paper end position data obtain sequence.

As well-known also in such a type of another printing apparatus in which cut paper is handled, a paper end positional adjustment registration correction function is provided, the paper passes through between paper guides 506 shown in FIG. 6, and once stops at a position of the registration rollers 406. Then, after the paper front end is corrected there, the paper is again conveyed. In this printing apparatus in which the registration correction mechanism is thus provided, the registration rollers 406 are driven to feed the paper, while nipping of the paper by use of the timing rollers 502 provided before the registration rollers 406 is temporarily released appropriately. By use of such a mechanism, the paper is prevented from being conveyed in a meandering manner, as disclosed by Japanese Laid-open Utility-Model Application No. 1-76835, for example.

The above-described nipping releasing mechanism in the timing rollers 502 is advantageous for a skew correction since a restriction on a movement of the paper at a rear end by the timing rollers 502 is removed while the paper front end is corrected by use of the registration rollers 406, even for a case where the paper is conveyed thereto with a large skew. However, in this configuration, the paper may easily shift in the paper width direction perpendicular to the paper conveyance direction. Such a tendency may be particularly remarkable for a case where paper having a long size is applied. At least one embodiment of the present invention is directed to solve this problem.

According to the related art, order to achieve printing start position correction in a paper width direction, paper end position data should be obtained by means of the line sensor 501, a printing start position correction amount is determined therewith and this correction amount should be reflected on the latent image production, before the scanning optical unit 402 carries out the latent image production on the photosensitive drum 403 based on the image data transmitted from the host system. In order to satisfy these temporal requirements, the mounting position of the line sensor 501 should be before the position of the timing rollers 502 along the paper conveyance path as shown in FIG. 6. However, in the related art, the above-mentioned shift of the paper at the registration rollers 406 occurring during the conveyance of the paper occurs after the latent image is already produced on the photosensitive drum 403 in the mechanism of FIG. 5. However, in the related art, as shown in FIGS. 4A through 4C, the operation that the paper end position data is obtained is triggered by paper reaching a timing sensor 504 shown in FIG. 6. As described above, this timing is before a possible paper shift at the registration rollers 406 occurs. Accordingly, when a paper shift actually occurs at the registration rollers, the printing start position correction in the paper width direction has already been carried out based on the paper end position data, obtained before this paper shift. As a result, the printing start position which has already been shifted by the amount of this paper shift at the registration rollers cannot be further corrected, and thus, the actual printing start position shifts from a proper position in the paper width direction. As shown in FIG. 6, a plurality of skew sensors 505 are provided at positions after the registration rollers 406 for the purpose of detecting a skew of the paper conveyed from the registration rollers 406. However, these sensors are those provided for detecting a front end positional error of the paper in the paper conveyance direction, not for detecting the paper's shift in the width direction.

In order to avoid such a printing start position error, in the related art, a pressure of paper conveyance rollers is adjusted for the purpose of reducing a possible paper skew as much as possible, a clearance of a paper guide not shown in the paper feeding device 409 is reduced for the purpose of avoiding a skew of the paper in the paper feeding device 409, or so, for example. However, such a countermeasure may not function sufficiently, and there may be a case where a paper skew occurs, and a printing start position error occurs accordingly.

According to one embodiment of the present invention, paper end position detection by use of the line sensor is carried out multiple times, i.e., the detection is carried out also after the paper is conveyed from the registration rollers and the latent image is produced on the photosensitive drum, in addition to the detection carried out before the latent image is produced on the photosensitive drum, so as to solve the above-mentioned problem which may occur in the related art as mentioned above.

According to one embodiment of the present invention, the paper shift in the width direction is detected by the line sensor also after the latent image is produced on the photosensitive drum, and then, the printing operation is stopped when a paper positional error thus detected exceeds a predetermined amount. Thereby, it is possible to avoid a problematic situation in which the printed paper having the printing start position shifted much is provided. Accordingly, it is possible to ensure improved reliability in the printing start position accuracy.

An embodiment of the present invention is described next with reference to FIGS. 1, 2A through 2D, 5 and 6.

In one embodiment of the present invention, a basic hardware configuration may be the same as the related art described above with reference to FIGS. 3, 4A through 4C, 5 and 6. Therefore, duplicated description therefore is omitted.

According to one embodiment of the present invention, as mentioned above, detection of paper end position in the width direction is carried out also after a production of a latent image or after a timing of a possible occurrence of paper shift phenomenon in the width direction. This scheme can be achieved by use of the line sensor for detecting paper end position in the width direction, a jam sensor (i.e., the timing sensor) for monitoring the paper reaching, and the printer control part controlling these parts, which are also included in the related art described above in terms of a basic hardware configuration of the apparatus.

When printing is started (Step S1 of FIG. 1), paper end position detection and paper skew check are carried out. First, paper is picked up from the sheet feeding device 409 shown in FIG. 5, and reaches the timing sensor 504 shown in FIG. 6. The printer control unit 510 of FIG. 6 determines in Step S2 whether or not the paper has reached the timing sensor 504. When the paper has reached the timing sensor 504 (Yes of Step S2), the printer control unit 510 obtains paper end position data by means of the line sensor 501 in Step S3 in the same manner as that described above for the related art. Then, in Step S4, the printing control unit 510 determines whether or not the obtained paper end position data corresponds to paper end position data after latent image production. As shown in FIGS. 2A and 2D, image data for a latent image to be produced on the photosensitive drum 403 by the scanning optical unit 402 has not been produced yet at this timing (Step S3). Accordingly, a determination result of Step S4 should be 'No'. As mentioned above for the related art, the latent image is produced after the printing start position correction data is generated. This generation of the printing start position correction data being made based on the paper end position detection data detected by the line sensor 501 (as shown in FIG. 2C), and the detection of the paper end position data is triggered by the paper detection by use of the timing sensor (as shown in FIG. 2A). The obtained paper end position data is compared with reference paper end position data previously recorded in a memory of the printer control part 510. Then, to the obtained difference therebetween, printing start position correction data which is set previously at a time of initial adjustment is added, in Step S5. Thus, a correction value for a printing start position is determined.

Then, in Step S6, the printing control part 510 outputs the obtained printing start position correction data to the printing start position correction circuit not shown. In the printing start position correction circuit, based on the printing start position correction data given, printing start position correction processing for a paper width direction is carried out on image data given by the host system. In Step S7, the printer control unit 510 determines whether or not the relevant paper is one to carry out the skew check processing. The skew check should be carried for paper having a long size for which a paper shift in the width direction may easily occur at the registration rollers 406. For example, in this embodiment, paper having a length in the paper conveyance direction is equal to or longer than 8.7 inches is determined as a target to be subject to the skew check processing. When the paper has a size less than 8.7 inches (No in Step S7), the current paper end position detecting sequence is finished without the skew check processing. On the other hand, when the paper has a size equal to or longer than 8.7 inches (Yes in Step S7), it is determined whether or not the paper has reached the skew sensor 505 (shown in FIG. 6) in Step S8. When the paper has reached the skew sensor 505 (Yes in Step S8), Step S3 is returned to, and paper end position data is again obtained by use of the line sensor 501, as shown in FIGS. 2B and 2C. This operation of obtaining the paper end position data should be carried out after the conveyance of the paper is stabilized in the width direction after the nipping of the paper by use of the timing rollers 502 is released. For this purpose, this operation to obtain the paper end position data is carried out after an elapse of a time interval of approximately 20 milliseconds (approximately 60 millimeters) after the detection of the paper reaching the skew sensor 505.

Then, it is determined whether or not the obtained paper end position data is one after the latent image is produced, in Step S4 again. As shown in FIGS. 2B, 2C and 2D, the detection of the paper end position data currently triggered by the paper detection by use of the skew sensor 505 is carried out after the generation of image data (corrected based on the paper end position data obtained as a result of being previously triggered by the paper detection by use of the timing sensor 504) for the latent image has been started. At this time, production of the latent image on the photosensitive drum 403 has been also started based on the generated image data. Therefore, currently, it is determined that the paper end position data obtained corresponds to one obtained after the production of the latent image (Yes in Step S4). Then, in Step S9, it is determined whether or not a skew error has occurred. This determination for a skew error is carried out from a comparison between the paper end position data obtained before the production of the latent image (obtained from the first detection in Step S3 in the previous loop) and the same after the production of the latent image (obtained from the second detection in Step S3 in the current loop). Specifically, when a difference therebetween is equal to or longer than 1.5 millimeters obtained from the comparison, it is determined that a skew error has occurred (Yes in Step S9). Then, in Step S10, error processing is carried out. Specifically, the current printing processing is interrupted, and a skew error report is transmitted to the host system. On the other hand, when the difference obtained from the comparison is less than 1.5 millimeters (No in Step S9), the current printing processing is continued.

The paper end position detection (first time) for the purpose of printing start position correction and the paper end position detection (second time) after the latent image production should be carried out, not only for the paper conveyed from the sheet feeding device but also for the paper for reverse-side printing conveyed from the both-side conveyance path. Thus, according to the embodiment of the present invention, it is possible to avoid, either for an obverse side printing occasion or for an reverse side printing occasion, a problematic situation that printing is carried out with a shift in the printing start position and the thus-obtained roblematic printed matter is provided.

The above-mentioned time interval, between the detection of paper reaching the skew sensor 505 and the actual paper end position detection (second time) after the latent image production, may be fixed, or may be made to be adjustable. Since an actual conveyance state of paper may vary depending on each particular type/size of the paper applied, this time interval may be adjusted depending on the particular paper length. Thereby, it is possible to improve the accuracy of the skew error detection. Further, by carrying out, several times, the detection of the paper end position (second time) after the latent image production, it is possible to improve the accuracy of the skew error detection.

Further, the present invention is not limited to the above-described embodiment, and variations and modifications may be made without departing from the basic concept of the present invention claimed below.

What is claimed is:

1. An electrophotographic printing apparatus for printing an image on an image transfer sheet medium by producing a latent image on a photosensitive unit and transferring the image to the image transfer sheet medium, comprising:

a width-directional positional sensor to detect a width-directional position of the image transfer sheet medium; and a printing start position control unit to control a printing start position on the photosensitive unit in a width direction of the image transfer sheet medium based on a detection result of the width-directional positional sensor, wherein:

the width-directional positional sensor detects a width-directional position of the image transfer sheet medium before and also after beginning to produce the latent image on the photosensitive unit, and detection results thereof are compared with one another; and it is determined from the comparison result whether or not printing operation is further continued.

2. The electrophotographic printing apparatus as claimed in claim 1, wherein:

a time interval between the detections of the width-directional position of the image transfer sheet medium by use of the width-directional positional sensor before and after the latent image production on the photosensitive unit is adjusted depending on a length of the image transfer sheet medium that is actually applied.

3. A printing system for printing an image on an image transfer sheet medium by producing a latent image and transferring the image to the image transfer sheet medium, comprising:

a width-directional positional sensor to detect a width-directional position of the image transfer sheet medium, before and after beginning to produce the latent image, several times during conveyance of the image transfer sheet medium to a transfer position at which the image is transferred to the image transfer sheet medium, wherein:

detection results of the width-directional positional sensor are used to determine whether or not a serious skew occurs in a printing result.

4. The printing system as claimed in claim 3, wherein:

the plurality of detections of the width-directional position of the image transfer sheet medium made several times during the conveyance of the image transfer sheet medium to the transfer position comprise detections before and after the image transfer sheet medium is conveyed past a predetermined position along the conveyance path at which a skew of the image transfer sheet medium may occur due to a mechanism provided for conveying the image transfer sheet medium to the transfer position.

5. The printing system as claimed in claim 4, wherein:

the mechanism provided for conveying the image transfer sheet medium to the transfer position comprises a plurality of holding units respectively to hold the image transfer sheet medium at different positions along the conveyance path; and the plurality of detections of the width-directional position of the image transfer sheet medium made several times during the conveyance of the image transfer sheet medium to the transfer position comprise a first detection in which a first holding unit of the plurality of holding units holds the image transfer sheet medium and a second detection after the first detection in which a second holding unit then holds the image transfer sheet medium while the first holding unit releases the same.

6. The printing system as claimed in claim 5, wherein:

the plurality of holding units comprise a plurality of pairs of rollers each pair of which holds the image transfer sheet medium by nipping the same therebetween.

* * * * *